US009572375B2

(12) United States Patent
Shinga et al.

(10) Patent No.: US 9,572,375 B2
(45) Date of Patent: Feb. 21, 2017

(54) VAPOR-PERMEABLE WATERPROOF SOCK

(75) Inventors: Ichiro Shinga, Nara (JP); Toshio Ando, Nara (JP)

(73) Assignee: OKAMOTO CORPORATION, Nara (JP)

( * ) Notice: Subject to any disclaimer, the term of this patent is extended or adjusted under 35 U.S.C. 154(b) by 913 days.

(21) Appl. No.: 13/364,530

(22) Filed: Feb. 2, 2012

(65) Prior Publication Data

US 2012/0198601 A1 Aug. 9, 2012

(30) Foreign Application Priority Data

Feb. 4, 2011 (JP) ..... P2011-022971

(51) Int. Cl.
*A41B 11/00* (2006.01)

(52) U.S. Cl.
CPC ..... *A41B 11/005* (2013.01); *A41B 2400/22* (2013.01)

(58) Field of Classification Search
CPC ..... A63B 71/1225; A41D 19/01; A41D 9/02; A41D 9/04; A41B 11/14; A41B 11/00
See application file for complete search history.

(56) References Cited

U.S. PATENT DOCUMENTS 4,445,233 A * 5/1984 Rubin ..... 2/239
4,635,626 A * 1/1987 Lerman ..... 602/61
4,809,447 A * 3/1989 Pacanowsky et al. ..... 36/9 R
5,244,716 A 9/1993 Thornton et al.
5,335,517 A * 8/1994 Throneburg et al. ..... 66/185
5,450,630 A * 9/1995 Hale ..... A41B 11/00 2/239
5,526,584 A 6/1996 Bleimhofer et al.
5,708,985 A * 1/1998 Ogden ..... 2/239
6,139,929 A * 10/2000 Hayton et al. ..... 428/35.2
6,336,227 B1 * 1/2002 Liput et al. ..... 2/239
(Continued)

FOREIGN PATENT DOCUMENTS

DE 9003341 5/1990
JP 08-007569 6/1933
(Continued)

OTHER PUBLICATIONS

"Our Business." Chori. N.p., Oct. 13, 2009. Web. Nov. 25, 2014.*
Japan Office Action, mail date is Jul. 8, 2014.
Search report from E.P.O., mail date is Feb. 24, 2015.

*Primary Examiner* — Sally Haden
(74) *Attorney, Agent, or Firm* — Greenblum & Bernstein, P.L.C.

(57) ABSTRACT

A vapor-permeable waterproof sock includes a cylindrical main body including a cloth having vapor permeability and that is waterproof. The vapor-permeable waterproof sock covers a range from a foot tip portion to a crus portion. The cylindrical main body includes a plurality of cloth areas, each of which expands and contacts more easily in one direction as compared with other directions. The plurality of cloth areas are joined together, and include a crus cloth area expanding and contracting more easily in a circumferential direction of the crus portion as compared with in a longitudinal direction of the crus portion, the crus cloth area covering the crus portion; and a planta portion cloth area expanding and contacting more easily in a longitudinal direction of the planta portion as compared with a width direction of the planta portion.

5 Claims, 5 Drawing Sheets

(56) References Cited

U.S. PATENT DOCUMENTS

| | | | | |
|---|---|---|---|---|
| 7,441,419 | B1 * | 10/2008 | Dollyhite et al. | 66/178 A |
| 2005/0087573 | A1 * | 4/2005 | Unsworth et al. | 223/112 |
| 2006/0021389 | A1 * | 2/2006 | Menzies | 66/185 |
| 2006/0287621 | A1 * | 12/2006 | Atkinson et al. | 601/151 |
| 2007/0135749 | A1 * | 6/2007 | Williams et al. | 602/62 |
| 2007/0204482 | A1 * | 9/2007 | Gibson-Collinson | 36/10 |
| 2009/0100877 | A1 * | 4/2009 | Kaneda | 66/182 |
| 2009/0137938 | A1 * | 5/2009 | Parivash | 602/63 |
| 2009/0288451 | A1 * | 11/2009 | Yokoyama | 66/185 |
| 2011/0015668 | A1 * | 1/2011 | Cros | 606/201 |
| 2011/0030125 | A1 * | 2/2011 | Shinga et al. | 2/239 |
| 2011/0319798 | A1 * | 12/2011 | DiGrazia | 602/3 |
| 2012/0022540 | A1 * | 1/2012 | Chasmawala et al. | 606/90 |
| 2012/0035510 | A1 * | 2/2012 | Cros et al. | 600/592 |
| 2012/0284902 | A1 * | 11/2012 | Matsuo et al. | 2/239 |
| 2013/0123679 | A1 * | 5/2013 | DiGrazia | 602/62 |
| 2013/0131572 | A1 * | 5/2013 | Cros et al. | 602/75 |
| 2013/0192311 | A1 * | 8/2013 | Alford et al. | 66/186 |
| 2014/0276321 | A1 * | 9/2014 | Sellitto | 602/29 |

FOREIGN PATENT DOCUMENTS

| | | |
|---|---|---|
| JP | 02-057908 | 4/1990 |
| JP | 2-26885 | 7/1990 |
| JP | 2651256 | 9/1997 |
| JP | 2002-061004 | 2/2002 |
| JP | 2008050744 A * | 3/2008 |

* cited by examiner

VAPOR-PERMEABLE WATERPROOF SOCK

BACKGROUND OF THE INVENTION

Field of the Invention

The present invention relates to a vapor-permeable waterproof sock having vapor permeability and waterproofness.

Related Background Art

In the articles fitted on foot portions such as socks that are put on foot portions, the articles having vapor permeability and waterproofness are conventionally known (for example, Japanese Patent No. 2651256 and Japanese Utility Model Publication No. Hei-2-26885). Japanese Patent No. 2651256 discloses a waterproof sock type article including a non-elastic, non-expandable and non-contractible planta component and calf component having waterproofness. Further, Japanese Utility Model Publication No. Hei-2-26885 discloses an article fitted on a foot portion which is constituted of a first cloth piece with which an upper portion from a heel portion is covered, and a second cloth piece with which a sole portion is covered, wherein the first and the second cloth pieces are formed by a material with a reinforcement piece attached to a porous stretched tetrafluoroethylene resin film.

In the waterproof sock described in Japanese Patent No. 2651256, the planta component and the calf component are non-elastic, non-expandable and non-contractible, and therefore, the problem arises, that the heel of a wearer is caught by the ankle portion which is the thinnest portion of the sock at the time of putting on the sock and it becomes difficult to put on and take off the sock. Further, the waterproof sock of Japanese Patent No. 2651256 is non-elastic, non-expandable and non-contractible, and therefore, the problem arises, that the sock does not fit to the foot of the wearer and makes it difficult for the wearer to walk in the worn state. Furthermore, the problems arise, that the clothing pressure given to the wearer is unsuitable, the wearer feels uncomfortable, and the like, which brings about the risk to inhibit blood circulation and cause swelling and fatigue easily. Further, in the article fitted on a foot portion described in Japanese Utility Model Publication No. Hei-2-26885, the reinforcement piece is attached to the porous stretched tetrafluoroethylene resin and inhibits expandability and contractibility. Therefore, it is difficult to put on and take off the article, only an insufficient fit is provided, and the same risk as in Japanese Patent No. 2651256 can be brought about.

The present invention is made to solve the problems as above, and has an object to provide a vapor-permeable waterproof sock capable of enhancing easiness in putting on and taking off the sock and enhancing a sense of good fit in the vapor-permeable waterproof sock having vapor-permeability and waterproofness.

SUMMARY OF THE INVENTION

A vapor-permeable waterproof sock according to the present invention includes a cylindrical main body including a cloth having vapor permeability and waterproofness, and covers a range from a foot tip portion to a crus portion, wherein the cylindrical main body includes a plurality of cloth areas, which expand and contract more easily in one direction as compared with in other directions, being joined together, and the plurality of cloth areas have a crus cloth area which expands and contracts more easily in a circumferential direction of the crus portion as compared with in a longitudinal direction of the crus portion, and covers the crus portion, and a planta portion cloth area which expands and contracts more easily in a longitudinal direction of the planta portion as compared with in a width direction of the planta portion, and covers the planta portion.

The vapor-permeable waterproof sock as above is formed of the cloth having vapor-permeability and waterproofness, and therefore, can prevent humidity and wetting due to perspiration, and can prevent entry of water into the sock. Further, the vapor-permeable waterproof sock is formed by a plurality of cloth areas, which expand and contract more easily in one direction as compared with in other directions, being joined together, and is configured to have the crus cloth area which expands and contracts easily in the circumferential direction of the crus and hardly expands and contracts in the longitudinal direction of the crus, and the planta portion cloth area which expands and contracts easily in the longitudinal direction of the planta portion and hardly expands and contracts in the width direction of the planta portion.

The crus cloth area easily expands and contracts in the circumferential direction. Therefore, when a heel portion which is larger as compared with the other body regions passes the cloth area, the cloth area expands in the circumferential direction, whereby passage of the heel portion can be made easy, and the heel portion can be prevented from being caught. The crus cloth area easily expands and contracts in the circumferential direction, and therefore, is easily fitted to a crus in accordance with the size in the circumferential direction of the crus. Further, the crus cloth area hardly expands in the longitudinal direction, and therefore, the sock can be smoothly put on and taken off.

Further, the crus cloth area is configured to expand and contract easily in the circumferential direction and hardly expand and contract in the longitudinal direction, and therefore, slipping down of the crus cloth area at the time of being worn can be suppressed.

Further, the planta portion cloth area easily expands and contracts in the longitudinal direction, and therefore, is easily fitted to a planta portion in accordance with the length of the planta portion. Further, the planta portion cloth area is configured to expand and contract easily in the longitudinal direction of the planta portion, and therefore, the wearer easily moves the foot. Therefore, the wearer can keep firm footing. Further, the planta portion cloth area expands and contracts in association with the movement of the foot, whereby displacement of the cloth inside a shoe (for example, inside a boot) can be prevented. Accordingly, a sense of good fit can be enhanced, and the wearer can be prevented from stumbling forward while walking. Further, since the planta portion cloth area easily expands and contracts in the longitudinal direction, occurrence of wrinkles in the planta portion cloth area can be suppressed, and a sense of discomfort in the planta portion due to occurrence of wrinkles can be suppressed. Thereby, inhibition of blood circulation due to occurrence of wrinkles can be prevented. Further, by the above, the vapor-permeable waterproof sock which hardly causes swelling and fatigue can be realized.

Here, a preferred configuration which provides the above described operation includes the configuration in which the cylindrical main body is formed by a plurality of the cloth areas, which expand and contract in only one direction, being joined together, and the plurality of cloth areas have the crus cloth area which expands and contracts in only the circumferential direction of the crus portion, and covers the crus portion, and a planta portion cloth area which expands and contracts in only the longitudinal direction of the planta portion, and covers the planta portion.

Further, the cylindrical main body preferably has a crus front side cloth area that is the crus cloth area which expands and contracts in only the circumferential direction of the crus portion, and covers a front side of the crus portion, a crus back side cloth area that is the crus cloth area which expands and contracts in only the circumferential direction of the crus portion, and covers a back side of the crus portion, and an instep portion cloth area which expands and contracts in only a longitudinal direction of an instep portion, and covers the instep portion.

Further, in the vapor-permeable waterproof sock, a join line at the back side, which corresponds to a joint of the crus back side cloth area and the planta portion cloth area, is preferably disposed to be deviated toward the foot tip portion from a heel portion, and a join line at the front side, which corresponds to a joint of the crus front side cloth area and the instep portion cloth area, is preferably disposed to be deviated toward the foot tip portion from the join line at the back side. Thereby, the end portion of the crus front side cloth area is disposed to be closer to the foot tip portion as compared with the heel portion, whereby the cloth can be expanded in the circumferential direction in accordance with the size of the heel portion, the heel portion can be prevented from being caught when the wearer puts on and takes off the sock, and a sense of good fit of the heel portion at the time of wearing the sock can be enhanced.

According to the vapor-permeable waterproof sock of the present invention, the vapor-permeable waterproof sock can be provided, which has a vapor permeating function and a waterproof function, can enhance easiness in putting on and taking off the sock and can enhance a sense of good fit.

DESCRIPTION OF THE PREFERRED EMBODIMENTS

Figure 1:
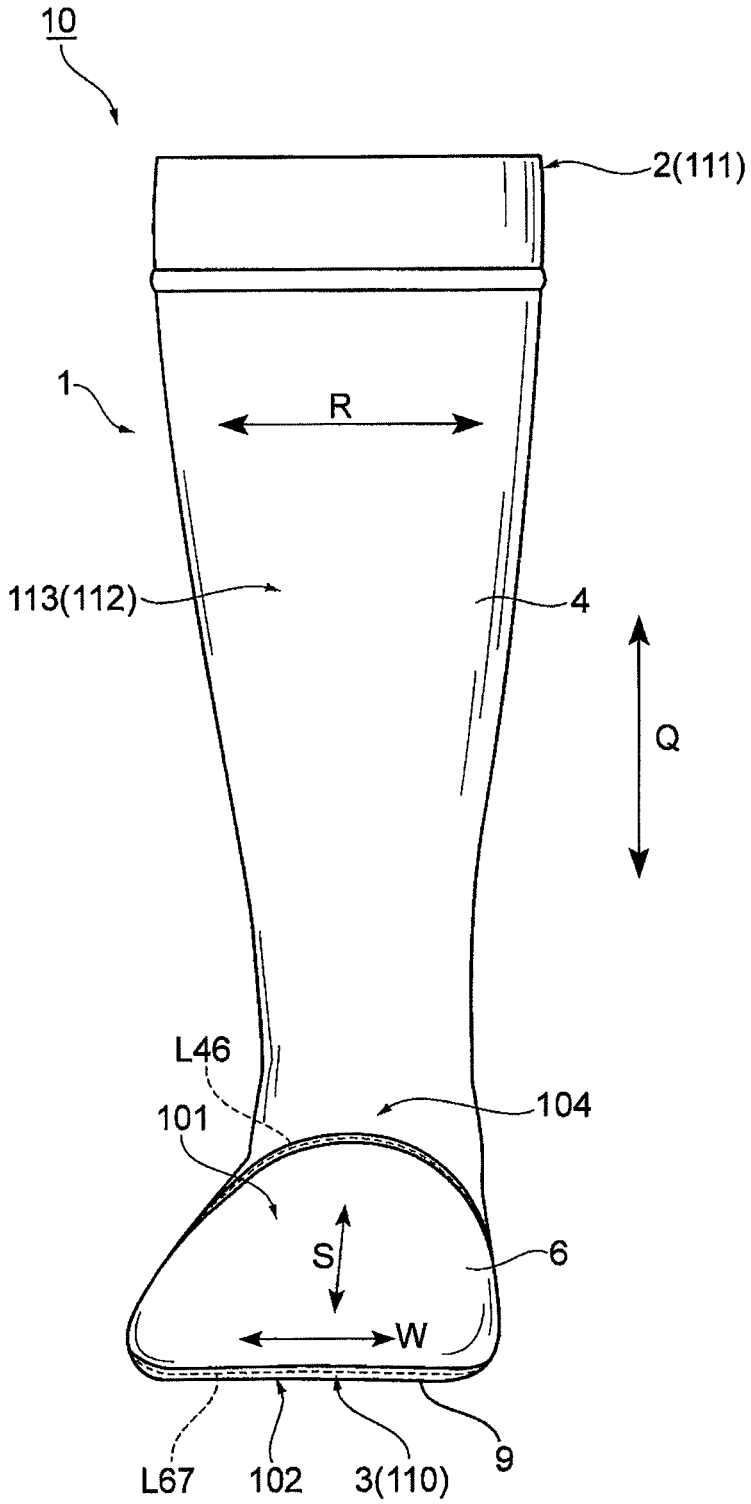
FIG. 1 is a front view showing a state of wearing a vapor-permeable waterproof sock (right leg) according to a first embodiment of the present invention.

Hereinafter, a preferred embodiment of the present invention will be described in detail with reference to the drawings. In the respective drawings, the same or the corresponding portions are assigned with the same reference numerals and characters. Further, the positional relationship of the top, bottom, right, left and the like are based on the positional relationship in the drawings.

Figure 2:
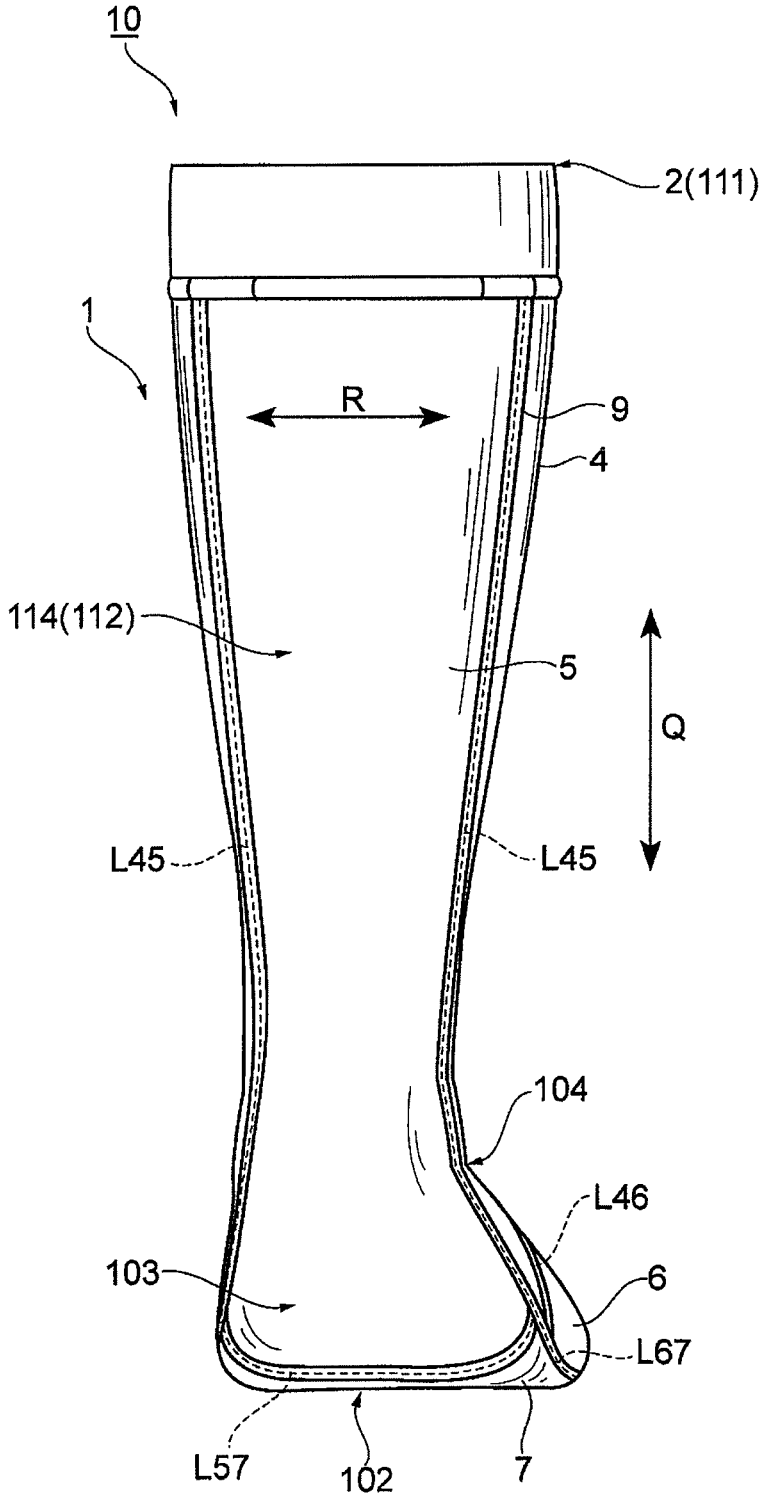
FIG. 2 is a rear view showing the state of wearing the vapor-permeable waterproof sock (right leg) according to the first embodiment of the present invention.
Figure 3:
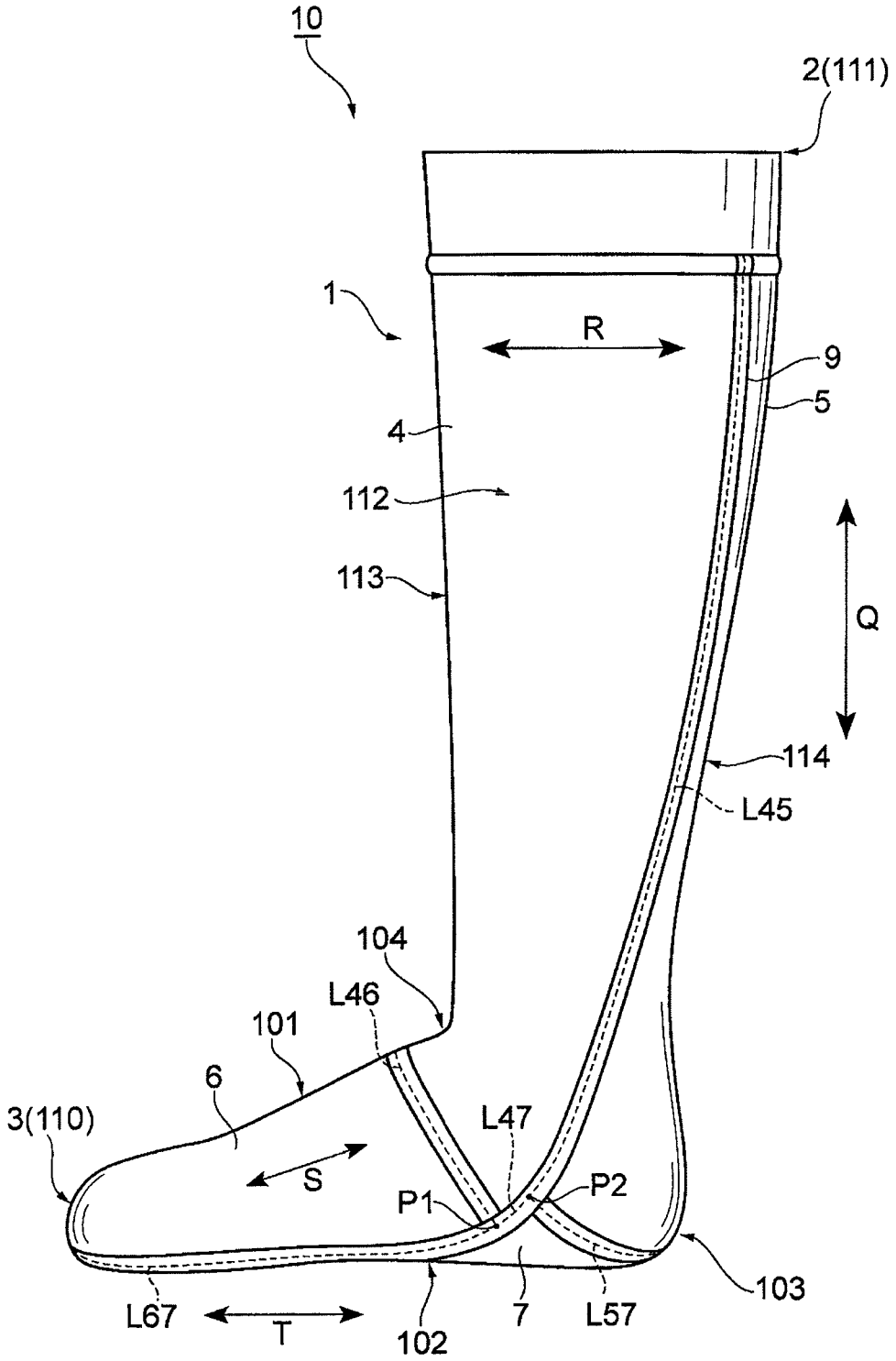
FIG. 3 is a left side view showing the state of wearing the vapor-permeable waterproof sock (right leg) according to the first embodiment of the present invention, from an inner side.
Figure 4:
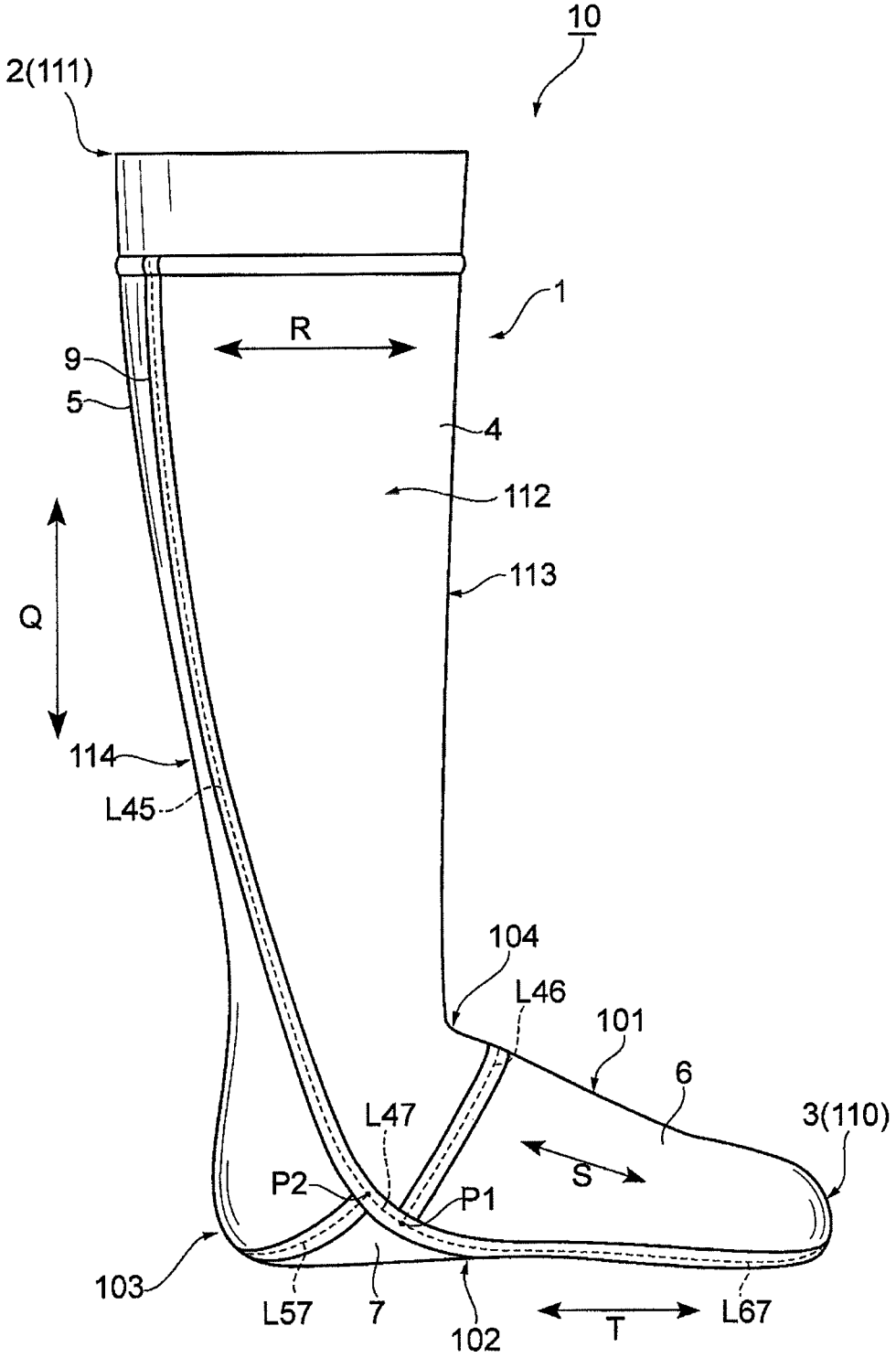
FIG. 4 is a right side view showing the state of wearing the vapor-permeable waterproof sock (right leg) according to the first embodiment of the present invention, from an outer side.

FIGS. 1 to 4 are views each showing a state of wearing a vapor-permeable waterproof sock (for a right leg) according to a first embodiment of the present invention. FIG. 1 is a front view. FIG. 2 is a rear view. FIG. 3 is a left side view. FIG. 4 is a right side view. FIGS. 1 to 4 each show the state of wearing the vapor-permeable waterproof sock with the front and the back of the vapor-permeable waterproof sock being reversed.

A vapor-permeable waterproof sock 10 according to the present embodiment includes a cylindrical main body portion (cylindrical main body) 1 with which a part of a wearer from a toe (foot tip portion) 110 to a crus portion (patella lower end 111) 112. One end portion (upper end portion) of the main body portion 1 is provided with an opening portion 2 for a leg portion of the wearer to insert through. Further, the other end portion of the main body portion 1 is joined and closed to form a toe portion (foot tip portion) 3.

The upper end portion of the main body portion 1 is sewn into, for example, a bag shape to form the opening portion 2. The opening portion 2 has expandability and contractibility in a circumferential direction (lateral direction illustrated in the drawing) R.

The main body portion 1 is formed from the toe 110 to a position reaching the patella lower end 111. More specifically, the main body portion 1 is formed to cover a toe, an instep, a sole (planta), an ankle, a heel, a shin, a calf and a patella lower end. The main body portion 1 includes a plurality of cloth areas (patches) 4 to 7 which expand and contract in only one direction, and is formed by these cloth areas 4 to 7 being joined together. In the present embodiment, a plurality of cloth areas 4 to 7 are constituted of a crus front side cloth area 4, a crus back side cloth area 5, an instep portion cloth area 6 and a planta portion cloth area 7.

The crus front side cloth area 4 expands and contracts in only a circumferential direction R of the crus portion 112 to cover a front side (hereinafter, called "crus portion front side") 113 of the crus portion 112. The crus back side cloth area 5 expands and contracts in only the circumferential direction R of the crus portion 112 to cover a back side (hereinafter, called "crus portion back side") 114 of the crus portion 112. The crus front side cloth area 4 and the crus back side cloth area 5 are disposed to face each other, have end portions in the circumferential direction R joined to each other, and form the cylindrical main body portion 1 which covers the crus portion 112.

The instep portion cloth area 6 expands and contracts in only a longitudinal direction S (anterior-posterior direction of the foot portion) of an instep portion 101 to cover the instep portion 101. The planta portion cloth area 7 expands and contracts in only a longitudinal direction T (anterior-posterior direction of the foot portion) of a planta portion 102 to cover the planta portion 102.

Next, an example of disposed joints of the plurality of cloth areas 4 to 7 in the worn state will be described. A join line L45 which is a joint of the crus front side cloth area 4 and the crus back side cloth area 5 extends in a vertical direction at both sides in a width direction of the crus portion back side 114 as shown in FIG. 2. Further, the join line L45 is disposed to be curved from the back side to the front side as the join line L45 extends downward from an upper end in side views as shown in FIGS. 3 and 4. The join portion is formed to be curved from the back side to the front side (ankle front side) in the lower position like this, and thereby, the main body portion 1 is adapted to the leg of the wearer and becomes fittable to the leg of the wearer.

A join line L67 which is a joint of the instep portion cloth area 6 and the planta portion cloth area 7 is formed to continue to the join line L45, as shown in FIGS. 3 and 4. The join line L67 is formed from the toe 110 to a region in the vicinity of a heel portion 103, and is formed to extend in a horizontal direction (lateral direction in the drawing) correspondingly to the planta portion 102 around the toe 110 and curve upward as the join line L67 approaches the heel portion 103 to continue to the join line L45. Further, the join line L67 extends in the lateral direction illustrated in the drawing in the toe 110 as shown in FIG. 1.

A join line L57 which is a joint of a lower end portion of the crus back side cloth area 5 and an end portion at the side of the heel portion 103, of the planta portion cloth area 7, is disposed to be inclined downward from horizontality as the join line L57 extends from the join line L45 to the heel portion 103 in side views, as shown in FIGS. 3 and 4.

A join line L46 which is a joint of a lower end portion of the crus front side cloth area 4 and an end portion at an ankle front side 104, of the instep portion cloth area 6, is disposed to be inclined to a front side (closer to the toe 110) relative to verticalness as the join line L46 extends from the join line L45 to the instep portion 101 in side views, as shown in FIGS. 3 and 4. Further, the join line L46 at the front side is disposed to be closer to the toe 110 as compared with the join line L57 at the back side. More specifically, an intersection point P1 of the join line L46 and the join line L67 is disposed to be closer to the toe 110 as compared with an intersection point P2 of the join line L57 and the join line L45.

A join line L47 which joins the crus front side cloth area 4 and the planta portion cloth area 7 is disposed between the intersection points P1 and P2. The join line L47 is formed to continue to the join line L45 and the join line L67.

The disposition of each of the join lines in the worn state changes in accordance with the size and the shape of the leg of a wearer, and the configuration may be adopted, in which the join lines are disposed in the positions different from the aforementioned positions.

Next, a method for joining the plurality of cloth areas 4 to 7 will be described. First, the adjacent cloth areas 4 to 7 are sewn up together. More specifically, the end portions are superimposed on each other and sewn up together by using a sewing machine, whereby a sewn portion is formed. Next, with use of for example, an ultrasonic sewing machine, the sewn portion is cut and the cut surfaces are butted to each other to be joined. Finally, a reinforcement tape 9 is bonded to the cloth areas along the skin side of the joined portion (join line). The cloths (patches) are joined to each other like this, whereby waterproof treatment for preventing entry of water is applied. The method of joining the cloths may be carried out according to the other methods. Further, the join line is preferably reinforced by the reinforcement tape 9, but the join line may be in the state not reinforced by the reinforcement tape.

The reinforcement tape 9 is of a three-layer structure, and is constituted of a woven fabric of 70% polyester and 30% polyurethane (base cloth), a heat-resisting film of 100% polyurethane (heat-resisting layer), and a resin of 100% polyurethane (adhesive layer) in the sequence from the surface layer to the adhesive layer. As the reinforcement tape 9 like this, MU-SEW TAPE (made by Nissinbo Holdings Inc., a trade name) can be adopted. Further, as the method for joining the reinforcement tape 9, for example, after the adhesive layer is melted with hot air and the reinforcement tape 9 is bonded, the reinforcement tape 9 is immediately cooled, and thereby, can be joined.

Next, the cloth which constitutes the main body portion 1 will be described. As the cloth constituting the main body portion 1, a vapor-permeable waterproof cloth is adopted. The specifications of the vapor-permeable waterproof cloth are described as follows.

Yarn: 100% polyester, 20 deniers, the number of filaments 24 for both the front cloth and the back cloth (Note that "the number of filaments" indicates the number of fibers constituting one yarn.)

Knitting: smooth knitting, 40 gauges (Note that "gauge" indicates tightness of stitches, and indicates the number of knitting needles per one inch.)

Structure: three-layer structure of the front cloth, the polyurethane special film, and the back cloth As the vapor-permeable waterproof cloth like this, ZAMZA (made by CHORI CO., LTD., a trade name) can be adopted. The vapor-permeable waterproof cloth is not limited to the above described specifications, and the other vapor-permeable waterproof cloths may be adopted. Further, the vapor-permeable waterproof cloth preferably has high heat-retaining properties and windbreak properties.

Next, an operation of the vapor-permeable waterproof sock 10 which is constituted as above will be described. First, a wearer can put on the vapor-permeable waterproof sock 10 by inserting a foot from the opening portion 2 similarly to ordinary socks. The wearer may wear the vapor-permeable waterproof sock 10 on an ordinary sock, or may directly wear the vapor-permeable waterproof sock 10 without wearing a sock. The wearer can wear a shoe (for example, a boot) or the like on the foot wearing the vapor-permeable waterproof sock 10.

According to the vapor-permeable waterproof sock 10 as above, the vapor-permeable waterproof sock 10 is formed of the cloth having vapor permeability and waterproofness. Therefore, humidity and wetting due to perspiration can be prevented, and entry of water into the sock can be prevented.

Further, in the vapor-permeable waterproof sock 10, the crus front side cloth area 4 and the crus back side cloth area 5 are expandable and contractible in the circumferential direction R of the crus portion 112, and therefore, when a heel which is large (long in the circumferential length) as compared with the other body regions (a toe and the like) passes through the region in the vicinity of the heel portion 103 of the crus back side cloth area 5, the crus front side cloth area 4 and the crus back side cloth area 5 expand in the circumferential direction R, whereby the heel can be prevented from being caught by the heel portion 103. Accordingly, passage in the heel portion 103 can be facilitated, and the vapor-permeable waterproof sock 10 which is easily put on and taken off can be realized.

Further, in the vapor-permeable waterproof sock 10, the crus front side cloth area 4 and the crus back side cloth area 5 expand and contract in the circumferential direction R, but do not expand and contract in a longitudinal direction Q of the crus portion 112, and therefore, the vapor-permeable waterproof sock 10 which is easily put on and easily taken off can be realized. For example, when the vapor-permeable waterproof sock 10 is taken off, expansion of the crus front side cloth area 4 and the crus back side cloth area 5 in the longitudinal direction Q is prevented, and the vapor-permeable waterproof sock 10 can be smoothly taken off.

Further, the crus front side cloth area 4 and the crus back side cloth area 5 of the vapor-permeable waterproof sock 10 expand and contract in the circumferential direction R, and therefore, the main body portion 1 is fitted to the crus portion 112 of the wearer in accordance with the size of the crus portion 112.

Further, the crus front side cloth area 4 and the crus back side cloth area 5 of the vapor-permeable waterproof sock 10 hardly expands and contracts in the longitudinal direction Q, and therefore, slipping down of the crus cloth areas 4 and 5 at the time of being worn can be reduced.

Further, in the vapor-permeable waterproof sock 10, the planta portion cloth area 7 expands and contracts in the longitudinal direction T, and therefore, the main body portion 1 becomes easily fittable onto the planta portion 102 of the wearer in accordance with the length of the planta portion (sole portion) 102 of the wearer. Further, since the planta portion cloth area 7 expands and contracts in the longitudinal direction T, the wearer easily moves the foot, and easily keeps firm footing. Furthermore, the planta portion cloth area 7 expands and contracts in association with the movement of the foot, and thereby, displacement of the cloth within the shoe can be prevented. Accordingly, a sense of good fit in the state of wearing the shoe can be enhanced, and the wearer can be restrained from stumbling forward while walking.

Further, some of the ordinary clothing items inhibit blood circulation to injure one's health and easily cause fatigue and swelling, due to wrinkles which occur at the joints, body end portions and the like while being worn. However, in the vapor-permeable waterproof sock 10, the planta portion cloth area 7 easily expands and contracts in the longitudinal direction T. Therefore, occurrence of wrinkles in the planta portion cloth area can be restrained, and a sense of discomfort in the planta portion 102 due to occurrence of wrinkles can be restrained. Thereby, inhibition of blood circulation due to occurrence of wrinkles can be prevented. From the above, the vapor-permeable waterproof sock which hardly causes fatigue can be realized.

Figure 5:
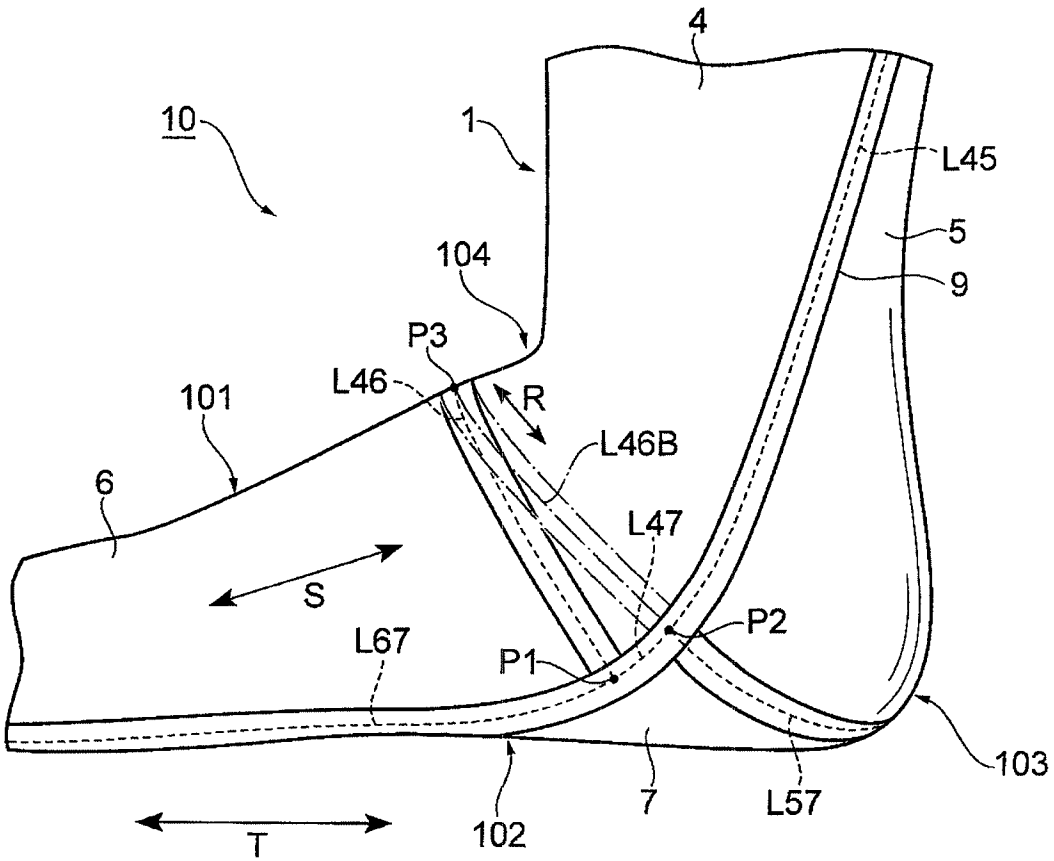
FIG. 5 is a side view showing a region in the vicinity of a heel portion of the vapor-permeable waterproof sock by enlarging the region.

FIG. 5 is a side view of the region in the vicinity of the heel portion 103 of the vapor-permeable waterproof sock 10 by enlarging the region. As shown in FIG. 5, in the vapor-permeable waterproof sock 10, the join line L46 at the front side and the join line L57 at the back side intersect the join lines L45 and L67 at the positions deviated from each other. More specifically, the intersection point P1 of the join line L46 at the front side is disposed to be deviated toward the toe from the intersection point P2 of the join line L57 at the back side. Therefore, the cloth can expand and contract in the R direction between a point P3 at the instep portion 101, of the join line L46, and the point P1 on the join line L45. As a result, expansion at the time of the heel of the wearer passing there becomes large as compared with the conventional sock, and easiness in putting on and taking off the sock is further enhanced. When a join line L46B is formed to connect the point P3 and the point P2 as in the conventional sock, the expansion in the R direction between the point P3 and the point P2 is restrained, but in the vapor-permeable waterproof sock 10, the cloth expands in the R direction between the point P3 and the point P2, and therefore, the sock becomes easy to put on and take off as compared with the conventional sock.

Further, in the vapor-permeable waterproof sock 10, the join line L46 at the front side is disposed to be deviated toward the toe from the join line L57 at the back side, and therefore, the cloth at the planta expands more easily than that at the join line L47 in the planta portion cloth area 7 in the vicinity of the heel portion 103. Accordingly, the cloth is easily curved upward in the vicinity of the heel portion 103, the cloth can be deformed to be along the shape of the heel portion 103, and a sense of good fit at the time of wearing the sock is enhanced.

The present invention is described specifically thus far based on the embodiment, but the present invention is not limited to the above described embodiment. In the above described embodiment, the main body portion 1 is configured to include the plurality of cloth areas 4 to 7, but the main body portion 1 may be formed by five or more cloth areas by dividing the cloth areas to form cloth areas. For example, the crus front side cloth area 4 may be divided in the circumferential direction to form a plurality of portions, and the crus front side cloth area 4 may be divided in the longitudinal direction to form a plurality of portions.

Further, the main body portion 1 may be formed by not more than three cloth areas. For example, the crus front side cloth area 4 and the instep portion cloth area 6 may be formed by one cloth as an integrated structure, and in this case, the portion which covers the instep portion 101 is formed to expand and contract in the circumferential direction. Similarly, the crus back side cloth area 5 and the planta portion cloth area 7 may be formed by one cloth as an integrated structure, and in this case, the portion which covers the crus portion back side 114 is formed to expand and contract in the longitudinal direction Q. Like this, the main body portion 1 can be formed by two or three cloth areas, but forming the main body portion 1 by the four cloth areas 4 to 7 as described above is effective to realize the vapor-permeable waterproof sock 10 which enhances a sense of good fit and is easily put on and taken off.

Further, in the above described embodiment, the crus front side cloth area 4 and the crus back side cloth area 5 are configured to expand and contract in only the circumferential direction R, but can be configured to expand and contract more easily in the circumferential direction R as compared with in the longitudinal direction Q. Similarly, in the above described embodiment, the instep portion cloth area 6 and the planta portion cloth area 7 are configured to expand and contract in only the longitudinal directions S and T, but can be configured to expand and contract more easily in the longitudinal directions S and T as compared with in the width direction W.

Further, the upper end portion of the main body portion 1 is not limited to the upper end portion which is formed up to the bottom of a knee. For example, the main body portion 1 may be formed up to the region in the vicinity of a crotch, or the vapor-permeable waterproof sock 10 of a short type in which the main body portion 1 is formed to only the top of an ankle may be adopted.

Further, the join line L46 at the front side and the join line L57 at the back side may be formed to continue to each other on the same straight line.

The vapor-permeable waterproof socks 10 of the present embodiment can prevent foot portions from getting wet by, for example, an angler or a fisherman using the vapor-permeable waterproof socks 10, and in addition, the vapor-permeable waterproof socks 10 can be used on the occasion of leisure-time amusement of an outdoor life, riding on a motorcycle and the like. Further, it is effective to wear the vapor-permeable waterproof socks 10 in the case of working in the places where the feet easily get wet in a fish market, on a boat, on the snow and the like. The use environment of the vapor-permeable waterproof socks 10 is not limited to the above environments.

What is claimed is:

1. A vapor-permeable waterproof sock comprising a cylindrical main body comprising a cloth having vapor permeability and waterproofness, the vapor-permeable waterproof sock adapted to cover range from a foot tip portion to a crus portion, wherein the cylindrical main body comprises a plurality of cloth areas, each of the plurality of cloth areas expanding and contracting more in one direction as compared with in other directions, the plurality of cloth areas being joined together, and the plurality of cloth areas comprise:

a crus cloth area having a crus front side cloth area that expands and contracts more in a circumferential direction of the crus cloth area as compared with in a longitudinal direction of the crus cloth area, the crus front side cloth area adapted to cover a front side of the crus portion;

the crus cloth area having a crus back side cloth area that expands and contracts more in the circumferential direction of the crus cloth area as compared with the longitudinal direction of the crus cloth area, the crus back side cloth area adapted to cover a back side of the crus portion; and a planta portion cloth area expanding and contracting more in a longitudinal direction of the planta portion cloth area as compared with in a width direction of the planta portion cloth area, the planta portion cloth area adapted to cover a planta portion;

an instep portion cloth area adapted to cover an instep portion; and a seam that joins the crus front side cloth area and the crus back side cloth area in the longitudinal direction of the crus cloth area, the seam comprising an arcuate portion, wherein a downwardly extending portion of the seam terminates in the arcuate portion proximate the planta portion cloth area, a first join line that joins the crus back side cloth area and the planta portion cloth area, wherein the first join line is disposed in a heel portion of the sock; and a second join line, the second join line comprising a sewn portion, that joins the crus front side cloth area and the instep portion cloth area, wherein the second join line is disposed to be deviated in a direction toward a tip end of the instep portion cloth area from the first join line, and wherein the arcuate portion intersects both the first join line and the second join line.

2. The vapor-permeable waterproof sock according to claim 1, wherein each of the plurality of cloth areas expand and contract in only one direction, wherein both the crus front side cloth area and the crus back side cloth area expand and contract in only the circumferential direction of the crus cloth area, and wherein the planta portion cloth area expands and contracts in only the longitudinal direction of the planta portion cloth area.

3. The vapor-permeable waterproof sock according to claim 2, wherein the instep portion cloth area expands and contracts in only a longitudinal direction of the instep portion cloth area.

4. The vapor-permeable waterproof sock according to claim 1, wherein the seam defines a third join line, the third join line being disposed to be curved from the crus back side cloth area to the crus front side cloth area as the third join line extends downward from an upper end of the sock.

5. The vapor-permeable waterproof sock according to claim 4, wherein the seam further defines a fourth join line that joins the instep portion cloth area and the planta portion cloth area, the fourth join line being disposed to curve upward as the fourth join line approaches the heel portion of the sock and continuing to the third join line.

* * * * *